United States Patent [19]

Yang

[11] Patent Number: 5,050,882

[45] Date of Patent: Sep. 24, 1991

[54] LIQUID FILLED RANDOM NUMBER DISPLAY DEVICE

[76] Inventor: Pao-Kung Yang, No. 6, Alley 13, Lane 406, Wu Chuan 3st, Taichung, Taiwan

[21] Appl. No.: 544,435

[22] Filed: Jun. 27, 1990

[51] Int. Cl.[5] ..... A63F 9/00

[52] U.S. Cl. ..... 273/144 B; 273/145 C; 273/457

[58] Field of Search ..... 273/1 L, 138 R, 144 R, 273/144 A, 145 R, 145 C; 446/153; 40/406, 409

[56] References Cited

U.S. PATENT DOCUMENTS 990,439 4/1911 Hill ..... 273/1 L 2,467,781 4/1949 Ribbe ..... 273/144 B 3,716,233 2/1973 Kotwas et al. ..... 273/1 L

*Primary Examiner*—Edward M. Coven

*Assistant Examiner*—William M. Pierce

*Attorney, Agent, or Firm*—Varndell Legal Group

[57] ABSTRACT

A numeral toy comprising a container divided into an upper chamber and a lower chamber with a separating board having a plurality of through holes. The interior of the container is filled with a liquid and a plurality of small numbered balls are normally kept in the lower chamber. When playing with this toy, the container is reversed upside down, so that numbered balls float up through the through holes in the separating board and stop under the top board of the container.

4 Claims, 4 Drawing Sheets

LIQUID FILLED RANDOM NUMBER DISPLAY DEVICE

BACKGROUND OF THE INVENTION

This invention concerns a numeral toy comprising a container filled with a kind of liquid and containing a plurality of small balls. The balls are each printed with a numeral, and the balls can be made to float on top of the liquid in a lower chamber of the container when the container is reversed upside down.

SUMMARY OF THE INVENTION

The numeral toy in the present invention comprises a container of any shape, a plurality of small balls having numerals printed thereon, a separating board and a kind of liquid as its main components.

The container is filled with the liquid and a little air, and completely sealed so as not to leak. The container is divided into two chambers by the separating board, i.e. upper and the lower chambers. The top board of the container has a larger ring fixed on its outer center, and the bottom board also has a larger ring fixed on its outer center. Another ring smaller than the larger rings on the top board and the bottom board is fitted within each of the larger rings, and a push button having a forked projection is forced in each of the smaller rings, so that each push button can be held by a finger for rotating the container using the rings, as pivots.

The bottom board of the container has a post protruding upward from its upper center which passes through a guide ring formed at the center of the separating board for maintaining said board at a predetermined distance from the bottom board, thereby dividing the interior of the container into two chambers.

The separating board is positioned in the interior of the container supported and held in place by the post of the bottom board. The separating board has a plurality of through holes for any of the small balls to pass nearly through in an upward direction when the container is reversed upside down. The separating board is also provided with a guide ring formed at its center which protrudes downward, and the guide ring has two small holes arranged on its opposite sides for air to pass through.

The plurality of small balls are made of a material of light specific gravity, so that they float on the liquid in the container, and respectively have numerals printed thereon which are different from one another. In addition, the numeral can be printed on several different spots on the ball.

When playing with this toy, the relative position of the top and bottom of the container is reversed, namely from the normal position into the upside-down position, by moving including or rotating the container, so that the numbered ball in the lower chamber will float up into any of the through holes in the separating board. The balls can not completely pass through the through holes because they are stopped by the bottom board, which is now at the top in the reversed position. This is because the distance between the separating board and the bottom board is a little shorter than the diameter of the small balls.

DETAILED DESCRIPTION OF THE INVENTION

Figure 1:
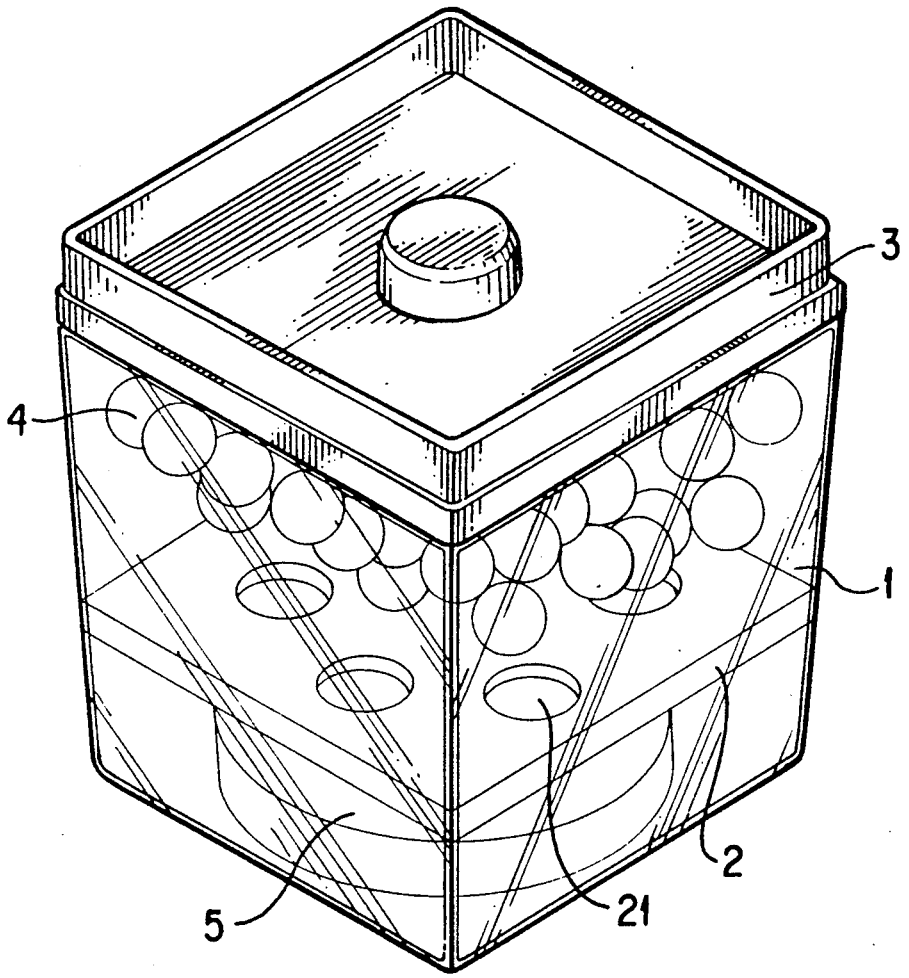
FIG. 1 is a perspectaive view of the numeral toy of the present invention.
Figure 2:
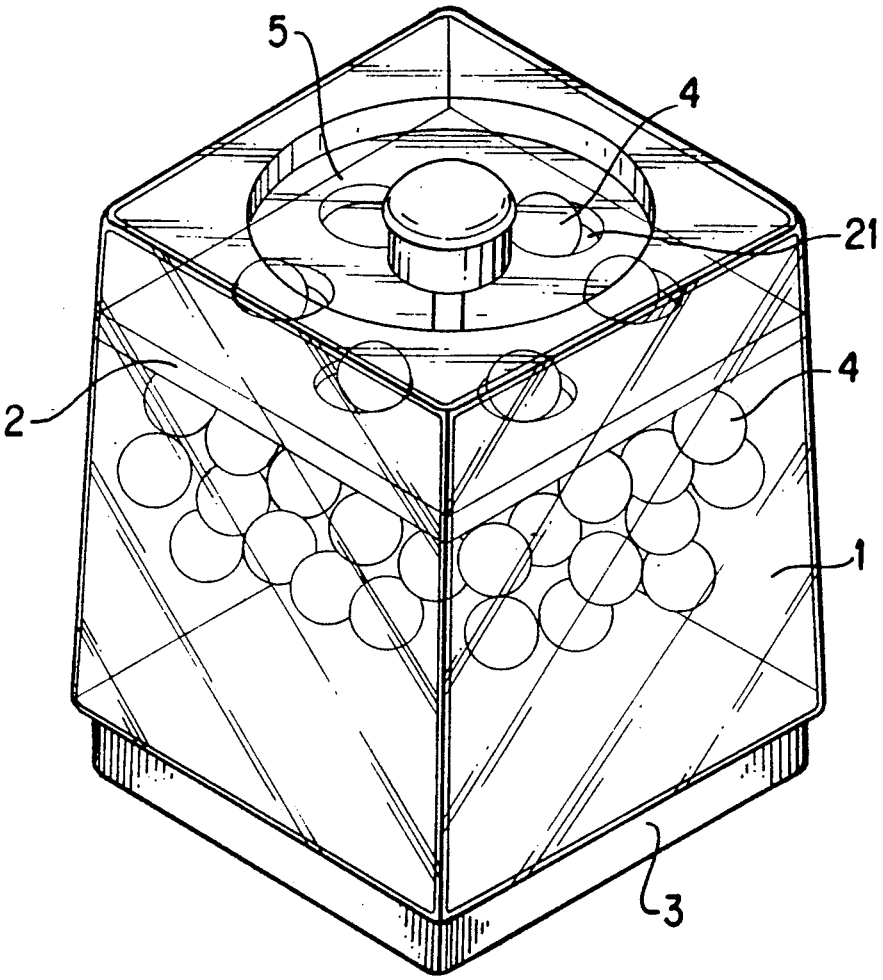
FIG. 2 is a perspective view of the numeral toy of the present invention with some numbered balls floating to the top board.
Figure 3:
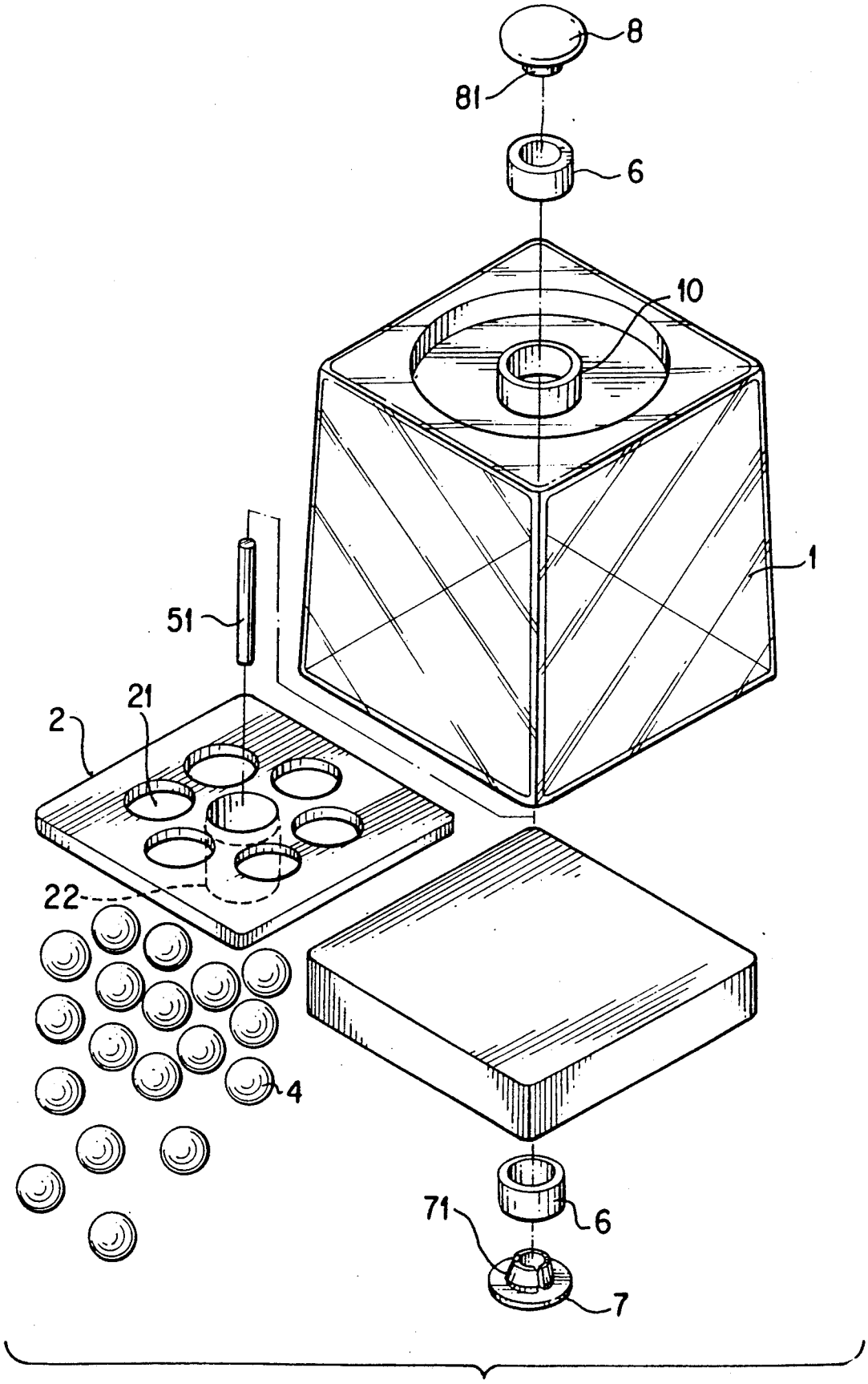
FIG. 3 is an exploded perspective view of the numeral toy of the present invention.

As shown in FIG. 3, the numeral toy in the present invention comprises a transparent container 1 which can preferably be square or round in its horizontal cross-section, a separating board 2, a plurality of small balls 4 and a liquid as the main components.

The separating board 2 perforated with a plurality of through or receiving holes 23, which are a little larger than the small balls, properly spaced apart in a circle and has a center guide ring 22 which projects downward from the center of said board 2. Two small through or air holes 23 and 24 are formed at the upper surface of the guide ring 22 for permitting air to pass therethrough. The separating board 2 is fixed in the interior of the container 1 at a proper height above the bottom board 5 by post 51. The distance between the separating board 2 and the bottom board 5 is a little shorter than the diameter of the balls, so that a ball 4 can almost pass through any of the through holes 21 in the separating board and be stopped by the bottom surface of the bottom board 5. With this arrangement the ball stays in the through hole 23 an can not completely leave said hole.

The top board 3 of the container 1 has a first ring 10 fixed on its outer center. A plurality of balls 4 bearing a numeral different from one another are deposited in the space between the top board 3 and the separating board 2 and are made of a material having lower specific gravity than the liquid, so as to float on the liquid container in said container 1.

The bottom board 5 has a first ring 10 of the same size as ring 10 of the top board 3 at its bottom center. A second ring 6 which has a smaller diameter than the rings 10 is fitted within each of the rings 10 on the bottom board 5 and the top board 3. Push buttons, 7, 8 each having a forked projection 71, 81 is forced into the rings 6 to retain the projection of said buttons 7, 8 within the ring without falling off. Thus, the container 1 can be rotated by holding the rings 6 on the top board 3 and under the bottom board 5 and using them as pivots.

Figure 4:
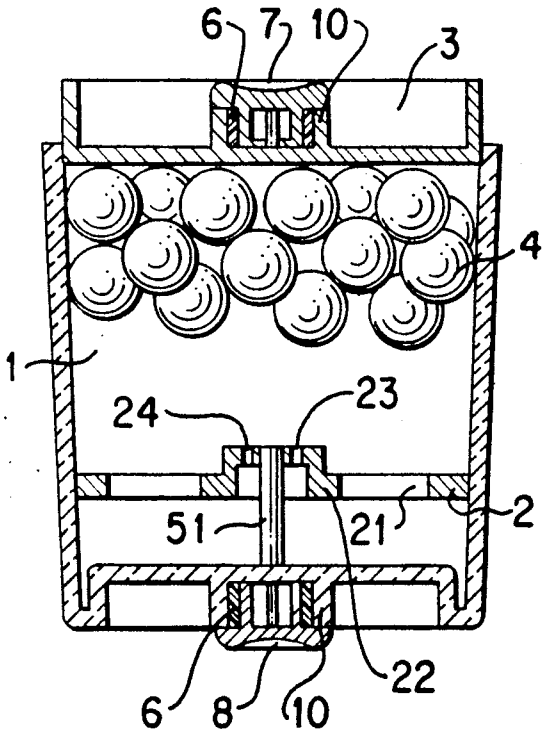
FIG. 4 is a cross-sectional view of the numeral toy of the present invention with the numbered balls all floating up to the top board.
Figure 5:
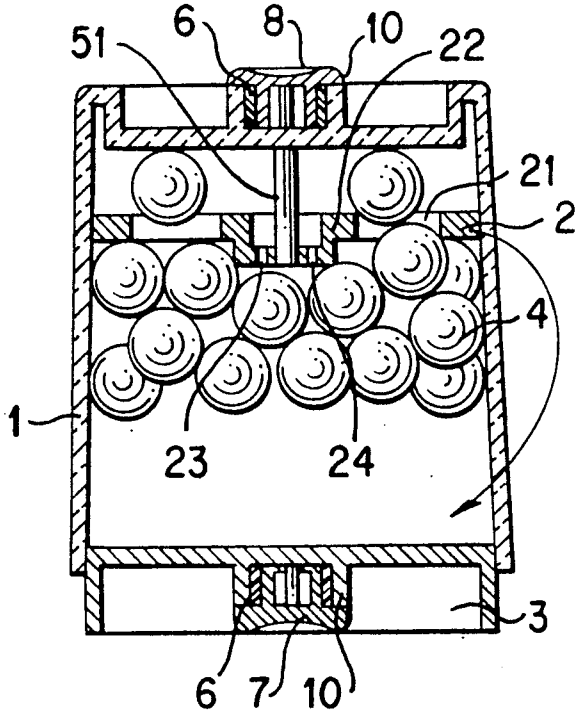
FIG. 5 is a cross-sectional view of the numeral toy of the present invention in the reversed upside down position.

Now, referring to FIGS. 4 and 5, the balls with numerals printed thereon deposited in the liquid in the container 1. The balls can always float up on the surface of the liquid, when the container 1 is placed in the original position as shown in FIG. 4 or in the upside-down position as shown in FIG. 5. When playing with this toy, the container 1 is reversed upside down from its original position, so that the numbered balls pass through holes 21 and are held therein under the top board 3, by moving, inclining or rotating the container 1. As mentioned above, the container 1 can be rotated by holding the push buttons 7 and 8 with fingers and then rotating it.

The number of the balls to be floated up through the through holes 21 can be altered by changing the number of said holes as desired.

What is claim is:

1. A numeral toy comprising:

a transparent container having a bottom board and containing a liquid and a plurality of small balls with each ball having a different numeral printed thereon, said plurality of small balls having a specific gravity lower than that of said liquid, said bottom board having a post extending upward from a center thereof; and a separating board having a center guide ring projecting downward from said separating board, said center guide ring secured to said guide post of said bottom board for holding said separating board a fixed distance from said bottom board, and said center guide ring having two small air holes for permitting air to pass therethrough, said separating board dividing said container into an upper chamber and a lower chamber and having a plurality of receiving holes arranged in a circle about said center guide ring;

wherein said plurality of balls are maintained in said lower chamber above said separating board when said container is in an upright position, and said plurality of small balls float into said plurality of receiving holes and are adjacent said bottom board when said container is in an upside-down position.

2. The numeral toy as claimed in claim 1, including a top board having a center, wherein said top board and said bottom board respectively have a first ring arranged at their centers, so that said container can be rotated horizontally using said first rings as pivots.

3. The numeral toy as claimed in claim 1, wherein said plurality of small balls are each respectively printed with the same numeral at different locations thereon.

4. The numeral toy as claimed in claim 2, including smaller second rings respectively rotatably received in said first rings, and push buttons having a forked projection respectively inserted into said smaller second rings and held in position by said forked projection.

* * * * *